US007066057B2

(12) United States Patent
Hsien

(10) Patent No.: US 7,066,057 B2
(45) Date of Patent: Jun. 27, 2006

(54) WRENCH WITH JAWS HAVING DIFFERENT TILT ANGLES

(76) Inventor: Chih-Ching Hsien, No. 367, Pei-Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/910,290

(22) Filed: Aug. 4, 2004

(65) Prior Publication Data

US 2006/0027051 A1 Feb. 9, 2006

(51) Int. Cl.
*B25B 13/02* (2006.01)

(52) U.S. Cl. ..... 81/119; 81/121.1

(58) Field of Classification Search ..... 81/119, 81/121.1, 124.4, 124.7, 125.1; B25B 13/02
See application file for complete search history.

(56) References Cited

U.S. PATENT DOCUMENTS

| | | | | | |
|---|---|---|---|---|---|
| 1,185,810 | A * | 6/1916 | Linstromberg | 81/119 |
| 1,261,565 | A * | 4/1918 | Leitner | 81/125.1 |
| 1,393,399 | A * | 10/1921 | Schlehr | 81/418 |
| 1,689,585 | A * | 10/1928 | Haschart | 81/125.1 |
| 2,332,602 | A * | 10/1943 | Rosenbloom | 81/125.1 |
| 2,687,056 | A * | 8/1954 | Foor | 81/125.1 |
| 6,715,383 | B1 * | 4/2004 | Hsien | 81/119 |
| 2005/0081686 | A1 * | 4/2005 | Hsien | 81/170 |

FOREIGN PATENT DOCUMENTS

JP 2002018737 A * 1/2002

* cited by examiner

*Primary Examiner*—Hadi Shakeri

(57) ABSTRACT

A wrench includes two jaws extending from a head on an end of a handle. Each jaw has an inclined surface defined in a first side thereof and the two inclined surfaces define tilt angles relative to a horizontal plane, which are different.

3 Claims, 6 Drawing Sheets

WRENCH WITH JAWS HAVING DIFFERENT TILT ANGLES

FIELD OF THE INVENTION

The present invention relates to a wrench having two jaws and each jaws includes an inclined surface so that the handle is oriented an angle relative to the surface on which the two jaws are rested and the user operates the handle with comfort.

BACKGROUND OF THE INVENTION

A conventional wrench is disclosed in FIG. 1 and generally includes a handle with a head which includes two jaws. The handle and the jaws are located at the same plane so that when using the wrench to rotate an object such as a bolt head, the handle and the two jaws are rested on the surface where the bolt is connected. The user has to lift the handle slightly and insert his fingers in the space between the surface and the handle. However, this also makes the head and the two jaws to be lifted an angle so that the two jaws embrace the bolt head at an angle. In other words, only limited clamping area of the two jaws contact the bolt head and this could make the jaws slip away from the bolt head.

The present invention intends to provide a wrench wherein the two jaws each have an inclined surface so that the handle is oriented upward when the two jaws are rested on the surface with their inclined surfaces. By this way, the user can hold the handle comfortably and the bolt head is clamped by the clamping surfaces of the two jaws.

SUMMARY OF THE INVENTION

The present invention relates to a wrench including a handle and a head connected to an end of the handle. A first jaw and a second jaw extend from the head. The first jaw has a first inclined surface defined in a first side thereof and the second jaw has a second inclined surface defined in a first side thereof. The first inclined surface and the second inclined surface are respectively tapered toward two respective distal ends of the first and second jaws. The first and second inclined surfaces share a common plane which is inclined relative to a horizontal plane so that when the first and second inclined surfaces are rested on a surface, the handle is oriented upward and the user can comfortably hold the handle while the object is clamped by the two jaws.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
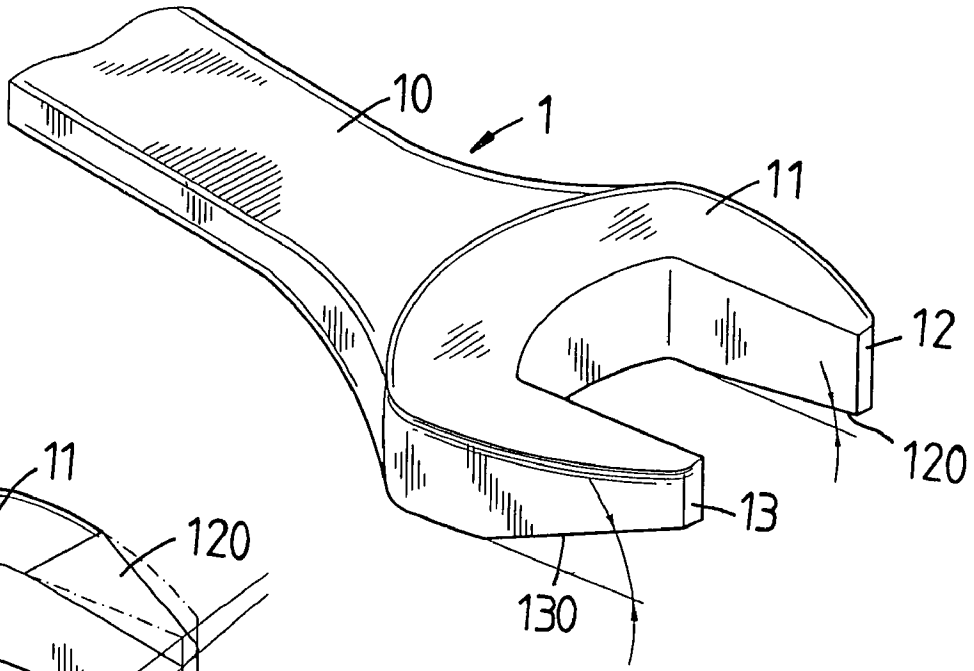
FIG. 1 is a perspective view to show the wrench and viewed from a second side of the wrench.
Figure 2:
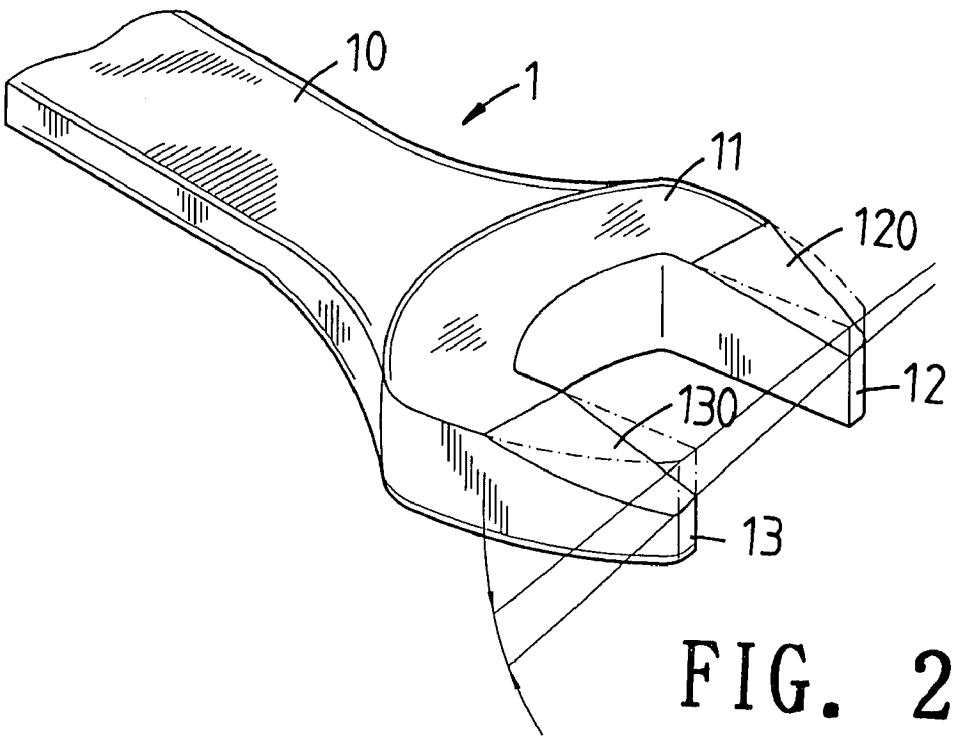
FIG. 2 is a perspective view to show the wrench and viewed from a first side of the wrench.
Figure 3:
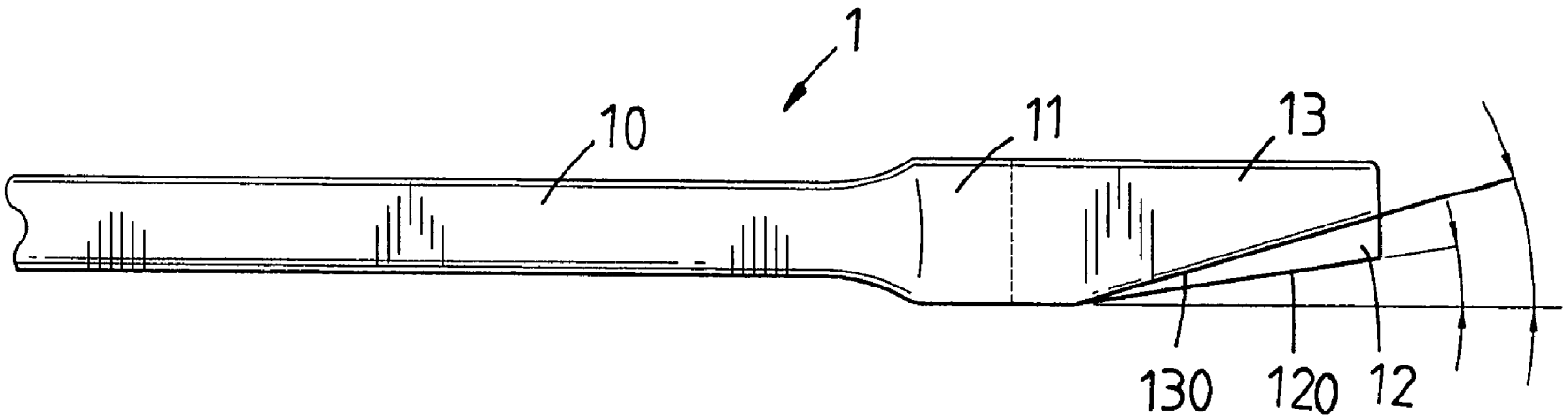
FIG. 3 shows the two inclined surfaces of the two jaws relative to the horizontal plane.

Refening to FIGS. 1 to 3, the wrench 1 of the present invention comprises a handle 10 and a head 11 connected to an end of the handle 10. A first jaw 12 and a second jaw 13 extend from the head 11 so as to define a space between the first and second jaws 12, 13. The first jaw 12 has a first inclined surface 120 defined in a first side thereof and the second jaw 13 has a second inclined surface 130 defined in a first side thereof. The first inclined surface 120 and the second inclined surface 130 are respectively tapered toward two respective distal ends of the first and second jaws 12, 13. The first and second inclined surfaces 120, 130 share a common plane which is inclined relative to a horizontal plane. A thickness of the distal end of the first jaw 12 is smaller than a thickness of the distal end of the second jaw 13, so that the tilt angle relative the horizontal plane of the first inclined surface 120 is different from the tilt angle relative the horizontal plane of the second inclined surface 130 as shown in FIG. 3. The common plane insects root portions of the first and second jaws 12, 13.

Figure 4:
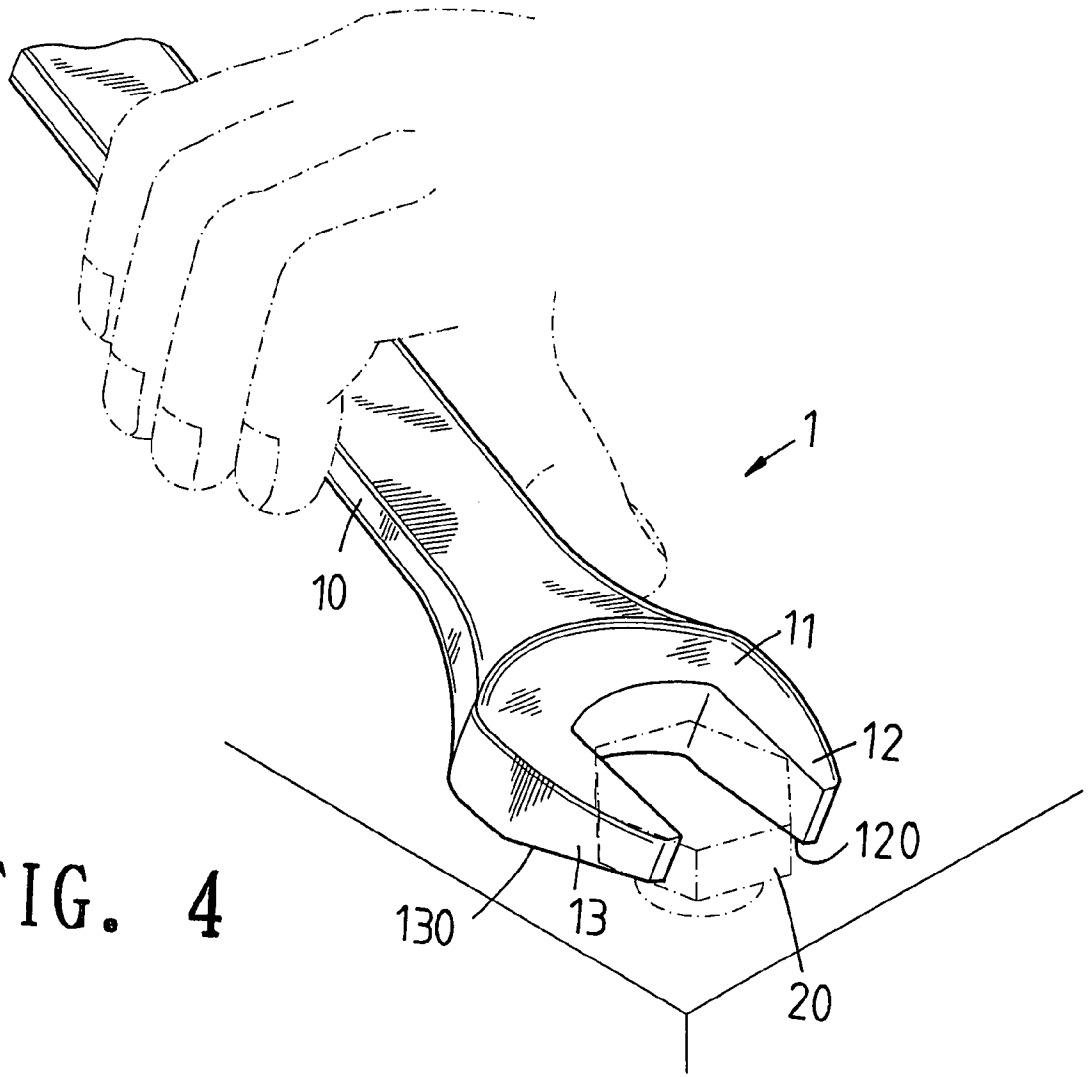
FIG. 4 shows the handle is oriented upward when the two jaws are respected on a horizontal plane.

As shown in FIG. 4, when using the wrench to rotate a bolt head 20 which is clamped between the first and second jaws 12, 13, the first and second inclined surfaces 120, 130 are rested on the surface where the bolt is connected. Because of the common plane which is inclined to a horizontal plane such as the surface where the bolt is connected, so that the handle 10 is oriented upward while the bolt head 20 is completely clamped by the first and second jaws 12, 13.

Figure 5:
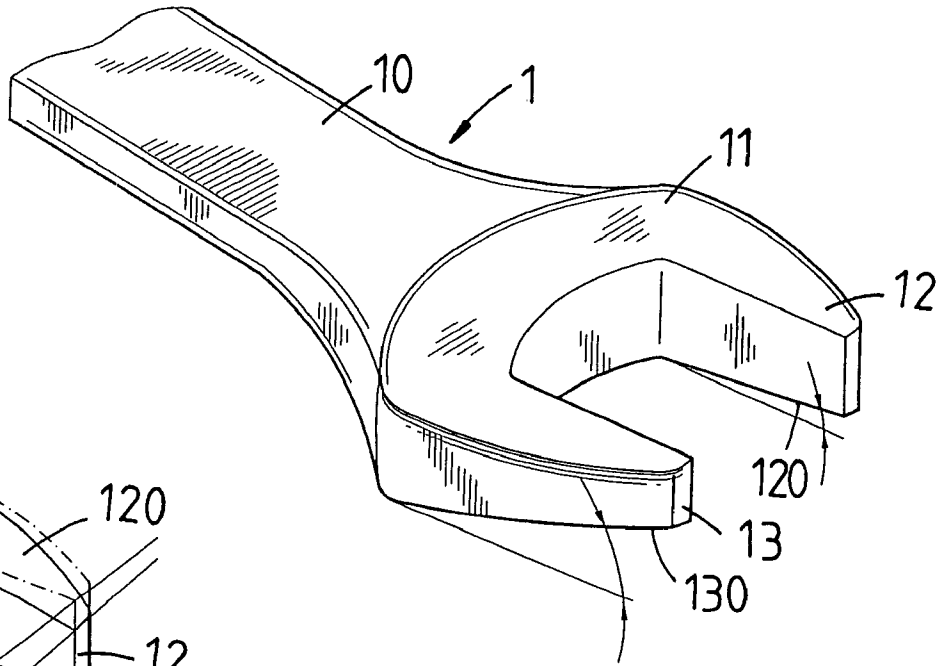
FIG. 5 is a perspective view to show another embodiment of the wrench and viewed from a second side of the wrench.
Figure 6:
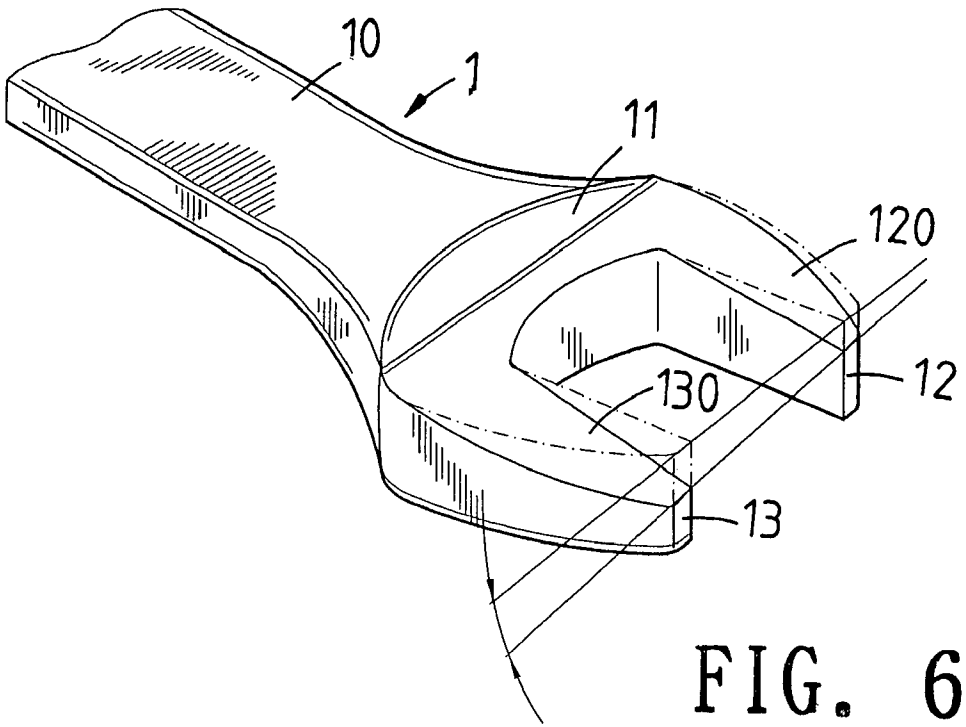
FIG. 6 is a perspective view to show the wrench in FIG. 5 and viewed from a first side of the wrench.
Figure 7:
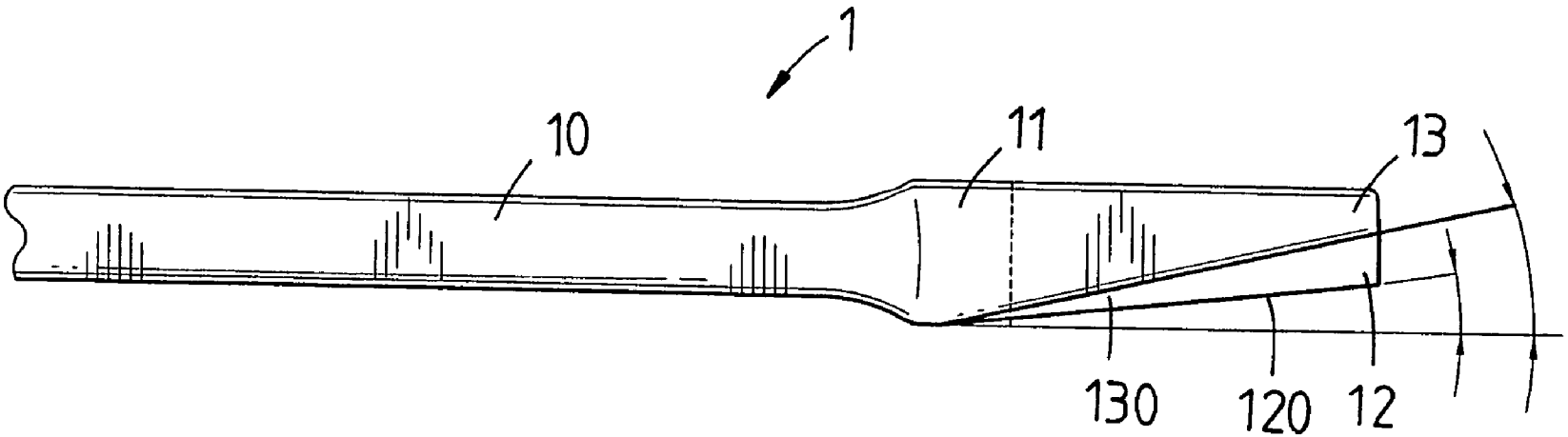
FIG. 7 shows the two inclined surfaces of the two jaws of the wrench in FIG. 5 relative to the horizontal plane.
Figure 8:
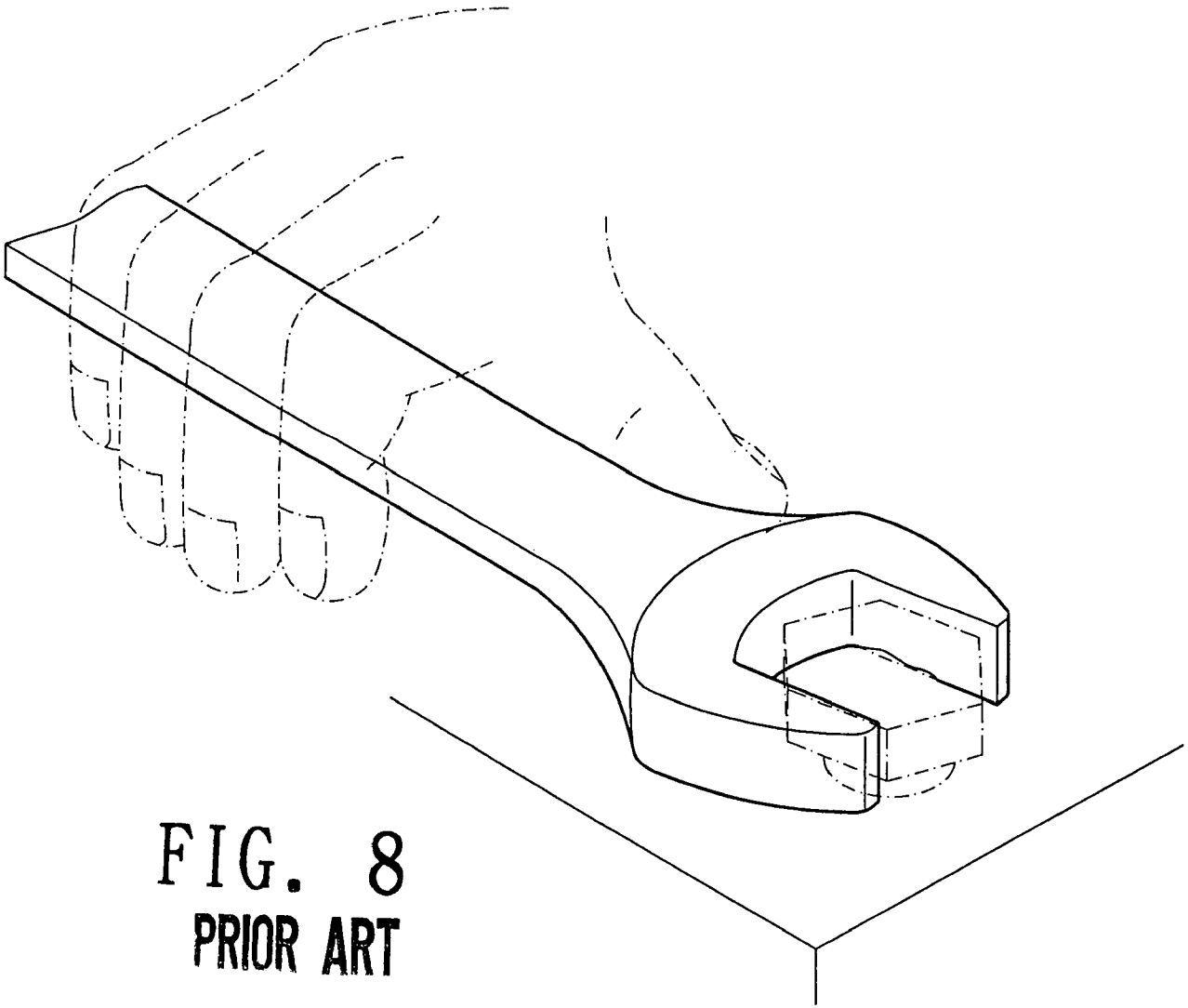
FIG. 8 PRIOR ART
FIG. 8 shows the user of a conventional wrench.

Referring to FIGS. 5 to 7, another embodiment of the wrench is identical to the embodiment as shown in FIGS. 1 to 4 except for that the common plane insects a root portion of the head 11.

While we have shown and described the embodiment in accordance with the present invention, it should be clear to those skilled in the art that further embodiments may be made without departing from the scope of the present invention.

What is claimed is:

1. A wrench comprising:

a handle and a head connected to an end of the handle and a first jaw and a second jaw extending from the head, the first jaw having a first inclined surface defined in a first side thereof and the second jaw having a second inclined surface defined in a first side thereof, the first inclined surface and the second inclined surface respectively tapered toward two respective distal ends of the first and second jaws defining respective tilt angles relative to a horizontal plane, the tilt angle relative to the horizontal plane of the first inclined surface is different from the tilt angle relative the horizontal plane of the second inclined surface, so that a thickness of the distal end of the first jaw is smaller than a thickness of the distal end of the second jaw.

2. The wrench as claimed in claim 1, wherein each respective inclined surface insects a respective root portion of the first and second jaws.

3. The wrench as claimed in claim 1, wherein each respective inclined surface insects a root portion of the head.

* * * * *